US009131293B2

(12) United States Patent
Cai et al.

(10) Patent No.: US 9,131,293 B2
(45) Date of Patent: Sep. 8, 2015

(54) MAGNETIC ASSEMBLY FOR SPEAKER

(71) Applicants: Bin Cai, Shenzhen (CN); Xingzhi Huang, Shenzhen (CN); Bo Xiao, Shenzhen (CN)

(72) Inventors: Bin Cai, Shenzhen (CN); Xingzhi Huang, Shenzhen (CN); Bo Xiao, Shenzhen (CN)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 14/448,623

(22) Filed: Jul. 31, 2014

(65) Prior Publication Data

US 2015/0117699 A1 Apr. 30, 2015

(30) Foreign Application Priority Data

Oct. 29, 2013 (CN) ..... 2013 2 0674666
Oct. 29, 2013 (CN) ..... 2013 2 0676595
Oct. 29, 2013 (CN) ..... 2013 2 0677093

(51) Int. Cl.
*H04R 1/00* (2006.01)
*H04R 15/00* (2006.01)

(52) U.S. Cl.
CPC . *H04R 1/00* (2013.01); *H04R 15/00* (2013.01)

(58) Field of Classification Search
CPC ..... H04R 9/06; H04R 9/025; H04R 15/00; H04R 1/00; H04R 13/00
USPC ..... 381/412, 420, 421, 422
See application file for complete search history.

(56) References Cited

U.S. PATENT DOCUMENTS

2011/0255734 A1* 10/2011 Marugami ..... 381/398
2012/0177246 A1* 7/2012 Shi et al. ..... 381/398
2014/0056445 A1* 2/2014 Li et al. ..... 381/152

* cited by examiner

*Primary Examiner* — Tuan D Nguyen
(74) *Attorney, Agent, or Firm* — Ipro, Inc.; Na Xu

(57) ABSTRACT

A magnetic assembly for a speaker is disclosed. The magnetic assembly includes a yoke, a magnet module installed on the yoke, and a pole module mounted on the magnet module. The magnet module includes a main magnet, a first secondary magnet and a second secondary magnet, the pole module includes a main pole plate, a first secondary pole plate and a second secondary pole plate. The first secondary pole plate includes a first pole protrusion extending perpendicularly from an edge thereof, and the second secondary pole plate includes a second pole protrusion extending perpendicularly from an edge thereof. The first pole protrusion and the second pole protrusion are located facing two opposite side walls of the main magnet respectively.

20 Claims, 6 Drawing Sheets

3

MAGNETIC ASSEMBLY FOR SPEAKER

FIELD OF THE DISCLOSURE

The present disclosure generally relates to electromagnetic technologies, and more particularly, to a magnetic assembly for a speaker.

BACKGROUND

Speakers are widely applied in mobile devices, such as mobile phones, portable media players or laptop computers, for converting electrical signals into audible sounds. Generally, a speaker includes a magnetic assembly and a voice coil. The magnetic assembly includes a yoke and a magnet module installed on the yoke. The magnet module typically includes a main magnet and a plurality of secondary magnets, the secondary magnets are symmetrically located around the main magnet, and cooperate with the main magnet to provide magnetic gaps for receiving the voice coil.

To meet miniaturization requirement of the speaker used in mobile devices, the magnetic assembly is desired to have an asymmetrical structure so that corner regions of the magnetic assembly can be used to install other components. However, the asymmetrical structure may cause magnetic fields within the magnetic assembly to be unevenly distributed. This may lead to a magnetic imbalance and lower an overall performance of the speaker.

Accordingly, the present disclosure provides an improved magnetic assembly to overcome the aforesaid problems.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and embodiments thereof.

Figure 1:
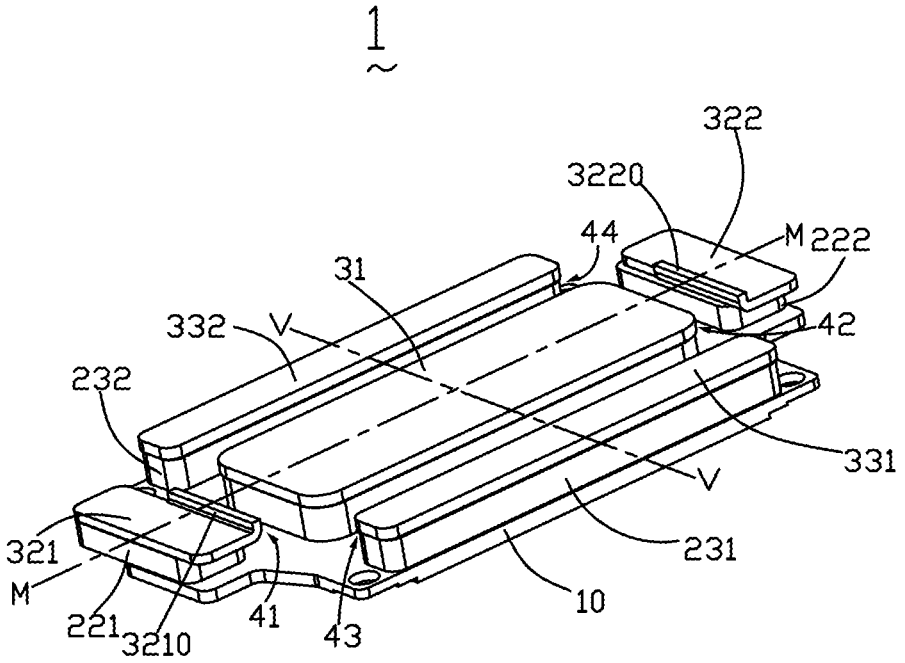
FIG. 1 is an isometric view of a magnetic assembly according to a first exemplary embodiment of the present disclosure.
Figure 2:
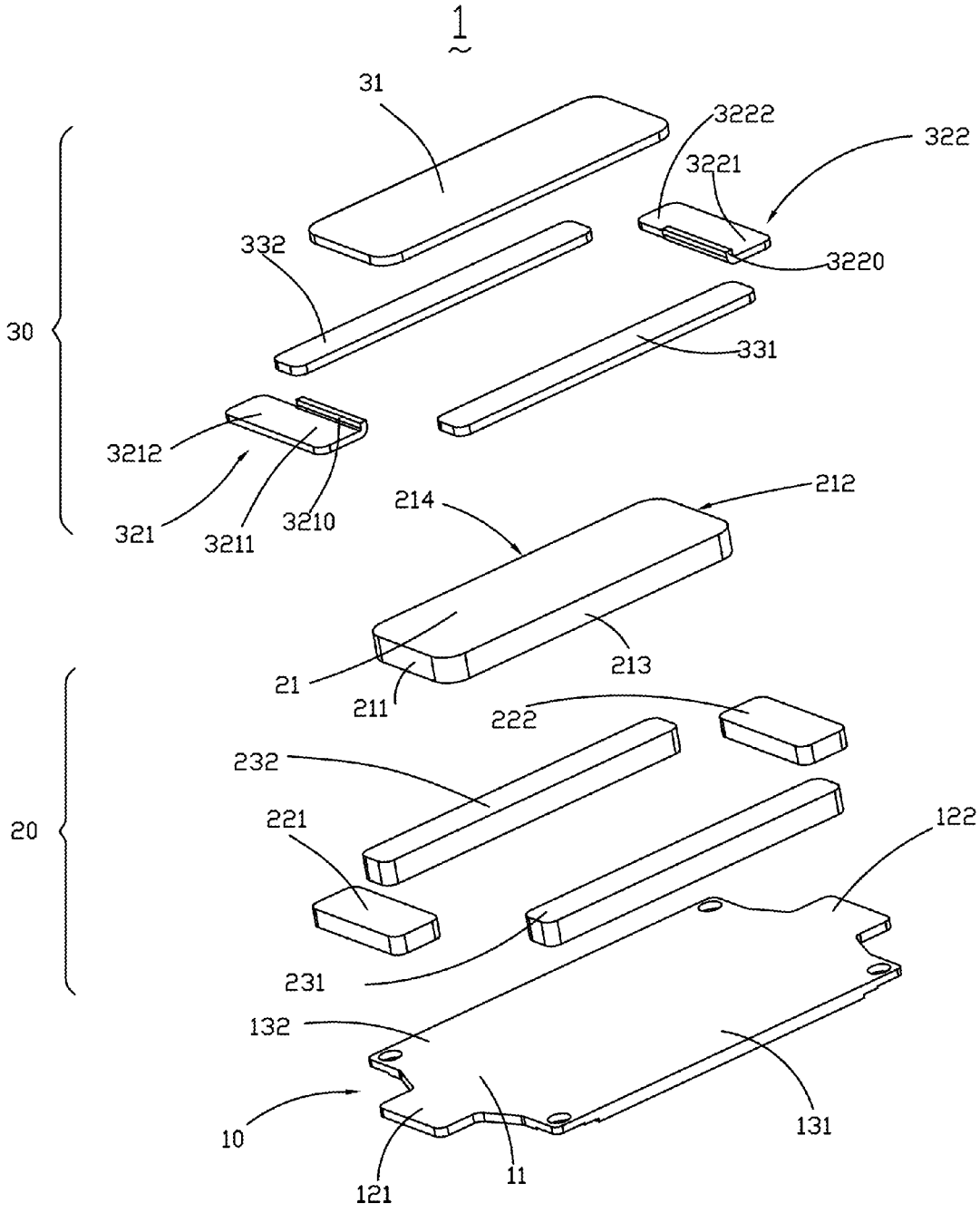
FIG. 2 is an exploded view of the magnetic assembly of FIG. 1.

Referring to FIGS. 1-2, a magnetic assembly 1 according to a first exemplary embodiment of the present disclosure is shown. The magnetic assembly 1 can be applied in a speaker of a mobile device, and includes a yoke 10, a magnet module 20 and a pole module 30. The magnet module 20 is installed on the yoke 10, and the pole module 30 is mounted on the magnet module 20.

The yoke 10 is a magnetic yoke which may be made by soft magnetic material with a high magnetic conductivity, such as soft iron, A3 type structural carbon steel, or soft magnetic alloy. The yoke 10 is used for magnetic transmission in a magnetic circuit. The yoke 10 includes a main yoke plate 11 disposed at a main central region of the yoke 10, and a plurality of yoke ears 121, 122, 131, 132 coplanar with the main yoke plate 11. In the present embodiment, the main yoke plate 11 has a substantially rectangular shape and the yoke ears 121, 122, 131, 132 extend from four sides of the main yoke plate 11 respectively. In the following description, the yoke ears 121, 122, 131, 132 are respectively named as a first yoke ear 121, a second yoke year 122, a third yoke ear 131 and a fourth yoke ear 132; wherein the first yoke ear 121 is opposite to the second yoke ear 122, and the third yoke ear 131 is opposite to the fourth yoke ear 132.

The magnet module 20 includes a main magnet 21 and a plurality of secondary magnets 221, 222, 231, 232 surrounding the main magnet 21. In the present embodiment, the secondary magnets 221, 222, 231, 232 are respectively named as a first secondary magnet 221, a second secondary magnet 222, a third secondary magnet 231 and a fourth secondary magnet 232. The main magnet 21, the first secondary magnet 221, the second secondary magnet 222, the third secondary magnet 231 and the fourth secondary magnet 232 may be permanent magnet components. The main magnet 21 is installed on the main yoke plate 11, and the first secondary magnet 221, the second secondary magnet 222, the third secondary magnet 231 and the fourth secondary magnet 232 are respectively installed on the first yoke ear 121, the second yoke ear 122, the third yoke ear 131 and the fourth yoke year 132.

The main magnet 21 has a substantially rectangular plate structure including four side walls 211, 212, 213, 214 connected in an end-to-end manner. Two opposite side walls 211, 212 correspond to two short edges of the rectangular main magnet 21, and the other two opposite side walls 213, 214 correspond to two long edges of the rectangular main magnet 21. In the present embodiment, a central axis parallel to the long edge of the main magnet 21 is defined as an axis M-M, and a central axis parallel to the short edge of the main magnet 21 is defined as an axis V-V, the axis M-M is perpendicular to the axis V-V and intersects the axis V-V at a central point of the main magnet 21. It should be noted that the main magnet 21 may have other structure in other embodiments, such as a round structure, an elliptical structure, or a ring structure.

The secondary magnets 221, 222, 231, 232 all have an elongated structure. The first secondary magnet 221 and the second secondary magnet 222 are opposite to each other, and are located parallel to the axis V-V and facing the two side walls 211, 212 of the main magnet 21 respectively; in addition, the first secondary magnet 221 and the second secondary magnet 222 are symmetrical to each other about the axis V-V. The third secondary magnet 231 and the fourth secondary magnet 232 are opposite to each other, and are located parallel to the axis M-M and facing the two long side walls 213, 214 of the main magnet 21 respectively; in addition, the third secondary magnet 231 and the fourth secondary magnet 232 are symmetrical to each other about the axis M-M. Moreover, a length of the first secondary magnet 221 and a length of the second secondary magnet 222 are substantially equal to a width of the main magnet 21, and a length of the third secondary magnet 231 and a length of the fourth secondary magnet 232 are substantially equal to a length of the main magnet 21.

In the magnetic assembly 1, a first magnetic gap 41 is formed between the main magnet 21 and the first secondary magnet 221, a second magnetic gap 42 is formed between the main magnet 21 and the second secondary magnet 222, a third magnetic gap 43 is formed between the main magnet 21 and the third secondary magnet 231, and a fourth magnetic gap 44 is formed between the main magnet 21 and the fourth secondary magnet 232. The first magnetic gap 41, the second magnetic gap 42, the third magnetic gap 43 and the fourth magnetic gap 44 communicate to each other and cooperate to form a ring-shaped magnetic gap for receiving a voice coil (not shown) and enabling the voice coil to vibrate therein. In the present embodiment, the first magnetic gap 41, the second magnetic gap 42, the third magnetic gap 43 and the fourth magnetic gap 44 may have a same width and a same depth.

Moreover, the first secondary magnet 221 and the second secondary magnet 222 deviate towards the fourth secondary magnet 232 along a direction parallel to the axis V-V. In other words, the first secondary magnet 221 and the second secondary magnet 222 are located adjacent to the fourth secondary magnet 232 in relative to the third secondary magnet 231, and accordingly, a distance between the first secondary magnet 221 and the fourth secondary magnet 232 is less than a distance between the first secondary magnet 221 and the third secondary magnet 231. Similarly, a distance between the second secondary magnet 222 and the fourth secondary magnet 232 is less than a distance between the second secondary magnet 222 and the third secondary magnet 231. With the configuration, a corner region of the magnetic assembly 1 between the first secondary magnet 221 and the third secondary magnet 231 as well as that between the second secondary magnet 222 and the third secondary magnet 231 can be used to install other components of a speaker in which the magnetic assembly 1 is applied.

The pole module 30 includes a main pole plate 31 and a plurality of secondary pole plates 321, 322, 331, 332 surrounding the main pole plate 31. In the present embodiment, the second pole plates 321, 322, 331, 332 are respectively named as a first second pole plate 321, a second secondary pole plate 322, a third secondary pole plate 331 and a fourth secondary pole plate 332. The main pole plate 31, the first secondary pole plate 321, the second secondary pole plate 321, the third secondary pole plate 331 and the fourth secondary pole plate 332 are respectively mounted on the main magnet 21, the first secondary magnet 221, the second secondary magnet 222, the third secondary magnet 231 and the fourth secondary magnet 232.

The main pole plate 31, the third secondary pole plate 331 and the fourth secondary pole plate 332 are respectively shaped as the main magnet 21, the third secondary magnet 231 and the fourth secondary magnet 231, that is, the main pole plate 31, the third secondary pole plate 331 and the fourth secondary pole plate 332 have a same length and a same width as the main magnet 21, the third secondary magnet 231 and the fourth secondary magnet 231 respectively. As such, the main pole plate 31, the third secondary pole plate 331 and the fourth secondary pole plate 332 are capable of completely covering the main pole plate 31, the third secondary pole plate 331 and the fourth secondary pole plate 332 respectively.

The first secondary pole plate 321 and the second secondary pole plate 323 have a same width as the first secondary magnet 221 and the second secondary magnet 222; nevertheless, the first secondary pole plate 321 and the second secondary pole plate 323 both have a length greater than the first secondary magnet 221 and the second secondary magnet 222. Therefore, an end of the first secondary pole plate 321 and an end of the second secondary pole plate 322, which are adjacent to the third pole plate 331, do not cover the first secondary magnet 221 and the second secondary magnet 222 respectively.

The first secondary pole plate 321 includes a first portion 3211 facing the first side wall 211 of the main magnet 21, and a second portion 3212 connected to the first portion 3212 and adjacent to the fourth secondary magnet 232. The first portion 3211 of the first secondary pole plate 321 has a length substantially equal to a width of the main magnet 21, and includes a first pole protrusion 3210 extending perpendicularly from an upper surface thereof adjacent to the main magnet 21 and thereby facing the main magnet 21. In the present embodiment, the first portion 3211 and the second portion 3212 of the first secondary pole plate 321 are integrated in one piece, and the first pole protrusion 3210 and a main body of the first portion 3211 are also integrated in one piece. In an alternative embodiment, the first pole protrusion 3210 and the main body of the first portion 3211 may be formed of two separate components respectively.

Similarly, the second secondary pole plate 322 includes a first portion 3221 facing the second side wall 212 of the main magnet 21, and a second portion 3222 connected to the first portion 3221 and adjacent to the fourth secondary pole plate 332. The first portion 3221 of the second secondary pole plate 322 has a length substantially equal to a width of the main magnet 21, and includes a second pole protrusion 3220 extending perpendicularly from an upper surface thereof adjacent to the main magnet 21 and thereby facing the main magnet 21.

Both the first pole protrusion 3210 and the second pole protrusion 3220 have a length substantially equal to the width of the main magnet 21. The first pole protrusion 3210 and the second pole protrusion 3220 face two opposite sides of the main magnet 21 respectively to form a symmetrical configuration along the axis V-V.

The first pole protrusion 3210 is configured for performing magnetic conduction on a magnetic field between the main magnet 21 and the first secondary magnet 221, and the second pole protrusion 3220 is configured for performing magnetic conduction on a magnet field between the main magnet 21 and the second secondary magnet 222. Thus, the magnetic fields within the first magnetic gap 41 and the second magnetic gap 42 can be evenly distributed. With the first pole protrusion 3210 and the second pole protrusion 3220, the magnetic imbalance that might otherwise exist in the magnetic assembly 1 can be reduced and an overall performance of the speaker in which the magnetic assembly 1 can be improved.

Figure 3:
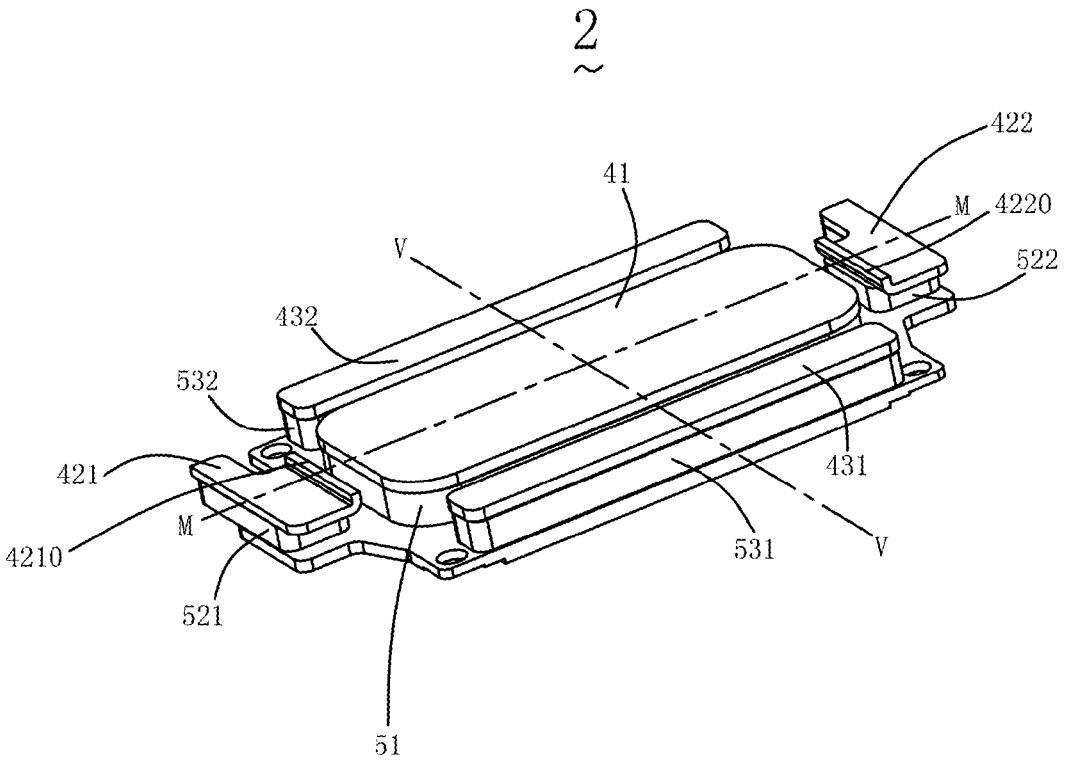
FIG. 3 is an isometric view of a magnetic assembly according to a second exemplary embodiment of the present disclosure.
Figure 4:
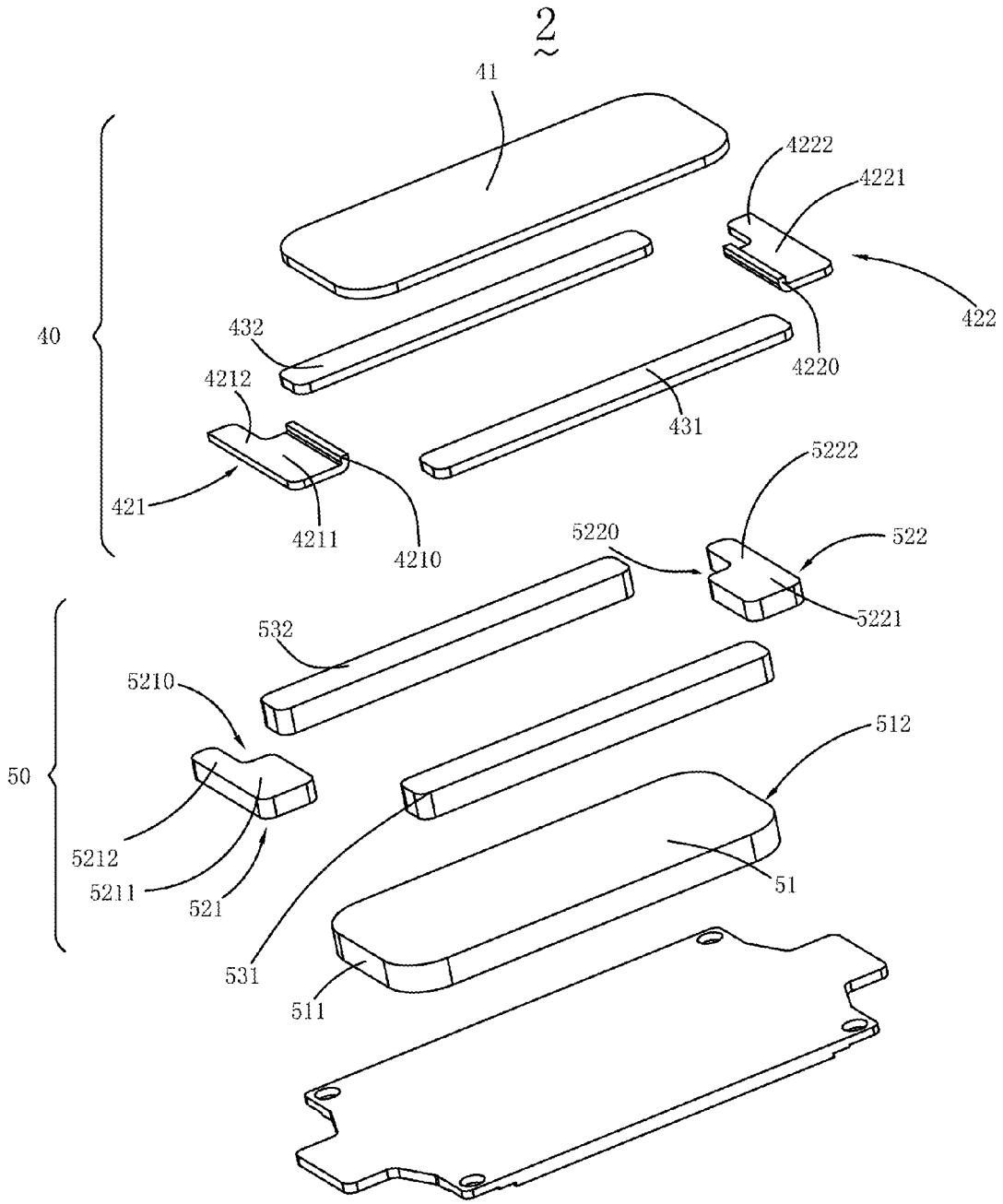
FIG. 4 is an exploded view of the magnetic assembly of FIG. 3.

Referring to FIGS. 3-4, a magnetic assembly 2 according to a second exemplary embodiment of the present disclosure is shown. The magnetic assembly 2 is similar to that of the magnetic assembly 1 as illustrated in FIGS. 1-2, the following description mainly describes differences between the magnetic assembly 2 and the magnetic assembly 1.

A magnet module 50 of the magnetic assembly 2 also includes a main magnet 51 and a plurality of secondary magnets 521, 522, 531, 532 (namely, a first secondary magnet 521, a second secondary magnet 522, a third secondary magnet 531 and a fourth secondary magnet 532), which are arranged in a configuration similar to the above-mentioned magnet module 20 in the magnetic assembly 1. Differing from the magnetic assembly 1, a first opening 5210 is formed at a corner of the first secondary magnet 521 adjacent to an end of the fourth secondary magnet 532, and a second opening 5220 is formed at a corner of the second secondary magnet 522 adjacent to the other end of the fourth secondary magnet 532.

Specifically, the first secondary magnet 521 includes a first main portion 5211 and a first extension portion 5212, the first main portion 5211 is located facing a first side wall 511 of the main magnet 51, the first extension portion 5212 extends from an end of the first main portion 5211 adjacent to the fourth secondary magnet 532. The first extension portion 5212 is designed to have a width less than of the first main portion 5211, so as to form the first opening 5210.

The second secondary magnet 522 includes a second main portion 5221 and a second extension portion 5222, the second main portion 5221 is located facing a second side wall 512 of the main magnet 51, the second extension portion 5222 extends from an end of the second main portion 5221 adjacent to the fourth secondary magnet 532. The second extension portion 5222 is designed to have a width less than of the second main portion 5221, so as to form the second opening 5220.

A pole module 40 of the magnetic assembly 2 also includes a main pole plate 41 and a plurality of secondary pole plates 421, 422, 431, 432 (namely, a first secondary pole plate 421, a second secondary pole plate 422, a third secondary pole plate 431 and a fourth secondary pole plate 432), which are also respectively mounted on the main magnet 51 and the secondary magnets 521, 522, 531, 532.

Differing from the magnetic assembly 1, the first secondary pole plate 421 and the second secondary pole plate 422 are respectively shaped corresponding to the first secondary magnet 521 and the second secondary magnet 522. That is, the first secondary pole plate 421 includes a first portion 4211 covering the first main portion 5211 of the first secondary magnet 521, and a second portion 4212 covering the first extension portion 5212 of the first secondary magnet 521; in addition, the first portion 4211 has a width greater than that of the second portion 4212 to form an opening (not labeled) at a corner of the first secondary pole plate 421 adjacent to an end of the fourth secondary pole plate 532.

The second secondary pole plate 422 includes a first portion 4221 covering the second main portion 5221 of the second secondary magnet 522, and a second portion 4222 covering the second extension portion 5222 of the second secondary magnet 522; in addition, the first portion 4221 has a width greater than that of the second portion 4222 to form an opening (not labeled) at a corner of the second secondary pole plate 422 adjacent to an end of the fourth secondary pole plate 532. The openings of the first secondary pole plate 421 and the second secondary pole plate 422 respectively correspond to the first opening 5210 of the first secondary magnet 521 and the second opening 5220 of the second secondary magnet 522.

Furthermore, the first secondary pole plate 421 and the second secondary pole plate 422 in the magnetic assembly 1 also includes a first pole protrusion 4210 and a second pole protrusion 4220 respectively for performing magnetic conduction within the magnetic assembly 2. In the present embodiment, due to the first opening 5210 and the second opening 5220, the magnetic fields relevant to the first extension portion 5212 and the second extension portion 5222 can be weakened, and thus further improving the magnetic balance of the magnetic assembly 2.

Figure 5:
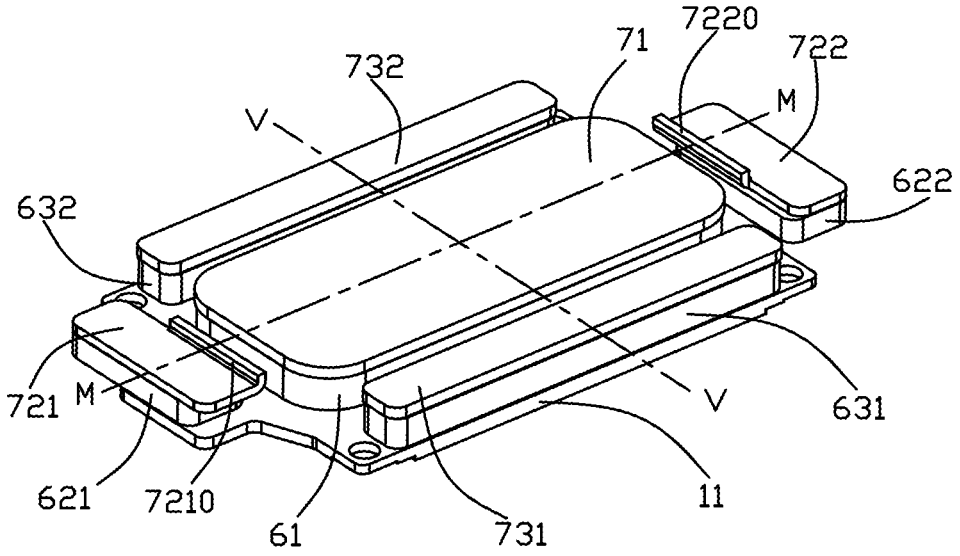
FIG. 5 is an isometric view of a magnetic assembly according to a third exemplary embodiment of the present disclosure.
Figure 6:
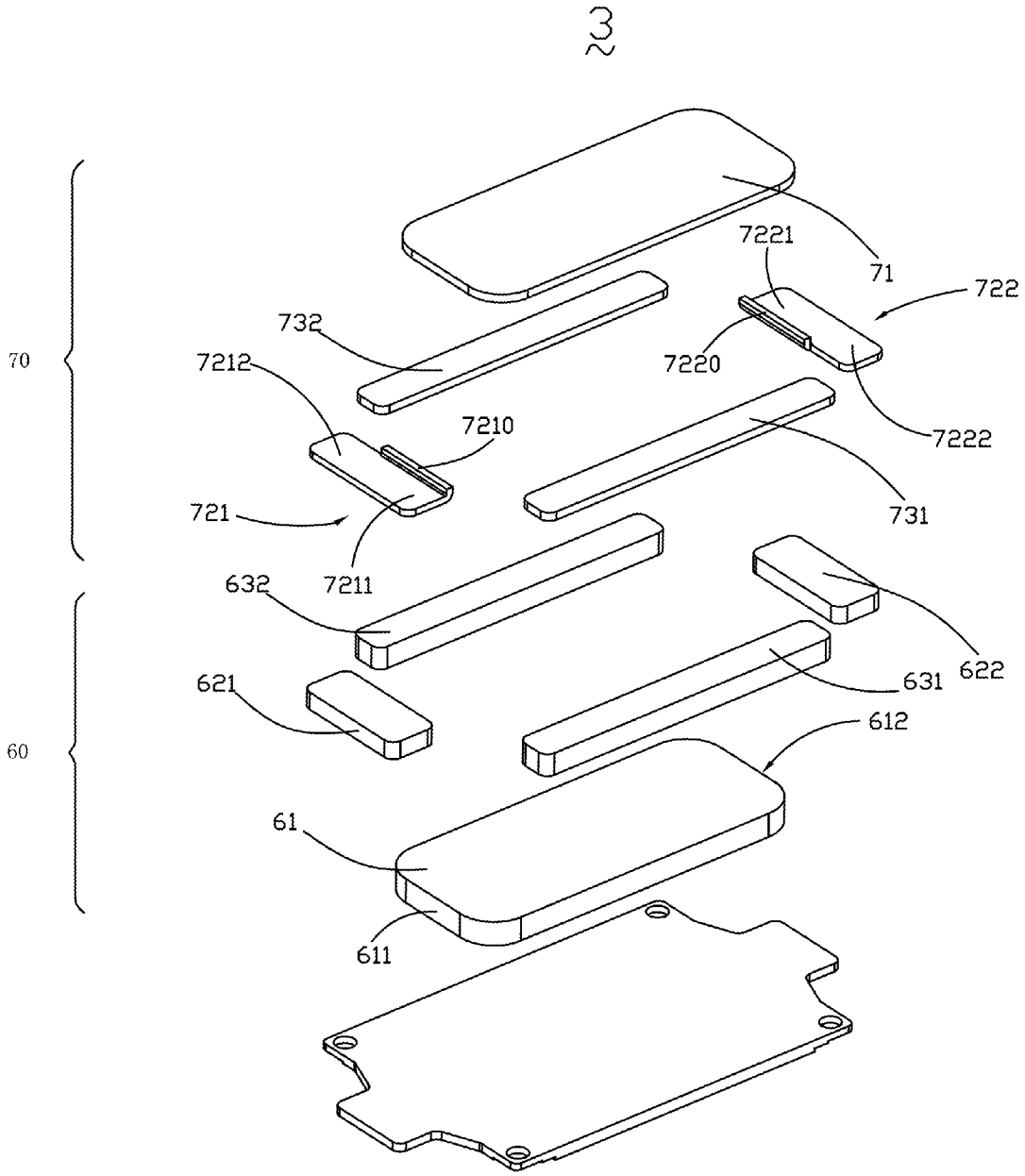
FIG. 6 is an exploded view of the magnetic assembly of FIG. 5.

Referring to FIGS. 5-6, a magnetic assembly 3 according to a third exemplary embodiment of the present disclosure is shown. The magnetic assembly 3 is similar to that of the magnetic assembly 1 as illustrated in FIGS. 1-2, the following description mainly describes differences between the magnetic assembly 3 and the magnetic assembly 1.

A magnet module 60 of the magnetic assembly 3 also includes a main magnet 61 and a plurality of secondary magnets 621, 622, 631, 632 (namely, a first secondary magnet 621, a second secondary magnet 622, a third secondary magnet 631 and a fourth secondary magnet 632). However, the first secondary magnet 621 and the second secondary magnet 622 deviate along two opposite directions rather than along a same direction. Specifically, the first secondary magnet 621 deviates towards the fourth secondary magnet 632 along a direction parallel to the axis V-V, and the second secondary magnet 622 deviates towards the third secondary magnet 631 along a direction parallel to the axis V-V. As such, the diagonal corner regions of the magnetic assembly 3 (i.e., regions between the first secondary magnet 621 and the third secondary magnet 631 as well as that between the second secondary magnet 622 and the fourth secondary magnet 631) can be used to install other components of a speaker in which the magnetic assembly 1 is applied.

In other words, the first secondary magnet 621 is located close to the fourth secondary magnet 632 while the second secondary magnet 622 is located close to the third secondary magnet 631. Therefore, a distance between the first secondary magnet 621 and the fourth secondary magnet 632 is less than a distance between the first secondary magnet 621 and the third secondary magnet 631, and a distance between the second secondary magnet 622 and the fourth secondary magnet 632 is greater than a distance between the second secondary magnet 622 and the third secondary magnet 631.

A pole module 70 of the magnetic assembly 3 also includes a main pole plate 71 and a plurality of secondary pole plates 721, 722, 731, 732 (namely, a first secondary pole plate 721, a second secondary pole plate 722, a third secondary pole plate 731 and a fourth secondary pole plate 732), which are also respectively mounted on the main magnet 61 and the secondary magnets 621, 622, 631, 632.

The first secondary pole plate 721 includes a first portion 7211 located facing a first side wall 611 of the main magnet 61, and a second portion 7212 connected to the first portion 7211 and locating adjacent to the fourth secondary pole plate 732. The first portion 7211 of the first secondary pole plate 721 includes a first pole protrusion 7210 extending perpendicularly from an edge thereof. The second secondary pole plate 722 includes a first portion 7221 located facing a second side wall 612 of the main magnet 61, and a second portion 7222 connected to the first portion 7221 locating adjacent to the third secondary pole plate 731. The first portion 7221 of the second secondary pole plate 722 includes a second pole protrusion 7220 extending perpendicularly from an edge thereof. The first pole protrusion 7210 and the second pole protrusion 7220 face two opposite sides of the main magnet 61 respectively, so as to improve a magnetic field distribution within the magnetic assembly 3.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A magnetic assembly, comprising:

a yoke;

a magnet module installed on the yoke, the magnet module comprising a main magnet and a plurality of secondary magnets, the secondary magnets comprising a first secondary magnet and a second secondary magnet disposed at two opposite sides of the main magnet respectively; and a pole module comprising a main pole plate and a plurality of secondary pole plates, the main pole plate being mounted on the main magnet, and the secondary pole plates comprising a first secondary pole plate mounted on the first secondary magnet, and a second secondary pole plate mounted on the second secondary magnet;

wherein the first secondary pole plate comprises a first pole protrusion extending perpendicularly from an upper surface thereof, and the second secondary pole plate comprises a second pole protrusion extending perpendicularly from an upper surface thereof, the first pole protrusion and the second pole protrusion respectively face two opposite side walls of the main magnet.

2. The magnetic assembly of claim 1, wherein each of the first secondary pole plate and the second secondary pole plate comprises a first portion facing the main magnet and a second portion connected to the first portion, the first pole protrusion extends perpendicularly from an upper surface of the first portion of the first secondary pole plate, and the second pole protrusion extends perpendicularly from an upper surface of the first portion of the second secondary pole plate.

3. The magnetic assembly of claim 2, wherein the secondary magnets further comprises a third secondary magnet and a fourth secondary magnet, the third secondary magnet and the fourth secondary magnet are disposed at the other two opposite sides of the main magnet respectively.

4. The magnetic assembly of claim 3, wherein the secondary pole plates further comprises a third secondary pole plate and a fourth secondary pole plate, the third secondary pole plate and the fourth secondary pole plate are respectively mounted on the third secondary magnet and the fourth secondary magnet.

5. The magnetic assembly of claim 4, wherein a distance between the first secondary magnet and the fourth secondary magnet is less than a distance between the first secondary magnet and the third secondary magnet; and a distance between the second secondary magnet and the fourth secondary magnet is also less than a distance between the second secondary magnet and the third secondary magnet.

6. The magnetic assembly of claim 5, wherein the second portions of first secondary pole plate and the second secondary pole plate are both located adjacent to the fourth magnet.

7. The magnetic assembly of claim 5, wherein a first opening is formed at a corner of the first secondary magnet adjacent to the fourth secondary magnet, and a second opening is formed at a corner of the second secondary magnet adjacent to the fourth secondary magnet.

8. The magnetic assembly of claim 7, wherein the first secondary pole plate comprises an opening corresponding to the first opening of the first secondary magnet, and the second secondary pole plate also comprises an opening corresponding to the second opening of the second secondary magnet.

9. The magnetic assembly of claim 4, wherein a distance between the first secondary magnet and the fourth secondary magnet is less than a distance between the first secondary magnet and the third secondary magnet; and a distance between the second secondary magnet and the fourth secondary magnet is greater than a distance between the second secondary magnet and the third secondary magnet.

10. The magnetic assembly of claim 9, wherein the second portion of first secondary pole plate is located adjacent to the fourth secondary magnet, and the second portion of the second secondary pole plate is located adjacent to the third secondary magnet.

11. A magnetic assembly for a speaker, comprising:

a yoke;

a main magnet mounted on a center of the yoke, the main magnet defining a first axial direction and a second axial direction perpendicular to the first axial direction;

a main pole plate mounted on a top of the main magnet;

a first magnet arranged opposed to an end of the main magnet;

a first pole plate attached to a top of the first magnet;

a second magnet arranged opposed to another end of the main magnet and opposed to the first magnet, a connection line between the first and second magnets being parallel to the first axial direction;

a second pole plate attached to a top of the second magnet;

wherein the first and second pole plates are such configured that each of the first and second pole plate is asymmetric about the first axial direction, and each of the first and second pole plate comprises a protrusion extending from an upper surface thereof respectively, the protrusion being symmetric about the first axial direction.

12. The magnetic assembly for a speaker of claim 11, wherein each of the first pole plate and the second pole plate comprises a first portion facing the main magnet and a second portion connected to the first portion, the protrusion extends perpendicularly from an upper surface of the first portion.

13. The magnetic assembly for a speaker of claim 12, further comprising a third magnet and a fourth magnet, wherein a connection line between the third and fourth magnets is parallel to the second axial direction.

14. The magnetic assembly for a speaker of claim 13, further comprising a third pole plate and a fourth pole plate, wherein the third pole plate and the fourth pole plate are respectively mounted on the third magnet and the fourth magnet.

15. The magnetic assembly for a speaker of claim 14, wherein a distance between the first magnet and the fourth magnet is less than a distance between the first magnet and the third magnet; and a distance between the second magnet and the fourth magnet is also less than a distance between the second magnet and the third magnet.

16. The magnetic assembly for a speaker of claim 15, wherein the second portions of first pole plate and the second pole plate are both located adjacent to the fourth magnet.

17. The magnetic assembly for a speaker of claim 15, wherein a first opening is formed at a corner of the first magnet adjacent to the fourth magnet, and a second opening is formed at a corner of the second magnet adjacent to the fourth magnet.

18. The magnetic assembly for a speaker of claim 17, wherein each of the first pole plate and the second polar plate comprises an opening respectively corresponding to the first opening of the first magnet and the second opening of the second magnet.

19. The magnetic assembly for a speaker of claim 14, wherein a distance between the first magnet and the fourth magnet is less than a distance between the first magnet and the third magnet; and a distance between the second magnet and the fourth magnet is greater than a distance between the second magnet and the third magnet.

20. The magnetic assembly for a speaker of claim 19, wherein the second portion of first pole plate is located adjacent to the fourth magnet, and the second portion of the second pole plate is located adjacent to the third magnet.

* * * * *